US005102364A

United States Patent [19]

Kubiatowicz

[11] Patent Number: 5,102,364

[45] Date of Patent: Apr. 7, 1992

[54] BALLOON WITH ELASTIC ELONGATE MEMBER SUPPORTING A DECORATIVE STRUCTURE

[75] Inventor: James F. Kubiatowicz, Fridley, Minn.

[73] Assignee: Odyssey, Inc., New Brighton, Minn.

[21] Appl. No.: 467,362

[22] Filed: Jan. 19, 1990

[51] Int. Cl.[5] ..... A63H 27/10; G09F 21/06

[52] U.S. Cl. ..... 446/220; 40/214

[58] Field of Search ..... 446/220, 222, 227, 236, 446/221, 224, 225; 40/613, 617, 212, 214

[56] References Cited

U.S. PATENT DOCUMENTS

| | | | |
|---|---|---|---|
| 2,463,517 | 3/1949 | Chromak | 446/220 X |
| 3,290,817 | 12/1966 | Kravath | 446/227 |
| 3,871,422 | 3/1975 | Elson et al. | 446/222 X |
| 4,291,487 | 9/1981 | Magid | 446/220 X |
| 4,934,986 | 6/1990 | Wallace | 446/222 |

FOREIGN PATENT DOCUMENTS

| | | | |
|---|---|---|---|
| 796826 | 4/1936 | France | 446/220 |
| 810660 | 3/1937 | France | 446/220 |
| 171947 | 12/1921 | United Kingdom | 40/617 |

OTHER PUBLICATIONS

"Inside ♥ Love" TM ad., p. 61, "Balloons Today" Magazine, Dec. 1989, published by Festivities Publications, Inc., Jacksonville, Fla.

*Primary Examiner*—Mickey Yu
*Attorney, Agent, or Firm*—William L. Huebsch

[57] ABSTRACT

A combination of a toy balloon; an elongate member comprising a resiliently elastic portion adapted to extend transverse of the cavity in the inflated balloon from an inlet portion of the balloon; structures or ways for attaching one end of the elongate member to the wall of the balloon at a position generally opposite its inlet portion and for securing a portion of the elongate member at the inlet portion so that upon a predetermined amount of inflation of the balloon the elongate member can be tensioned with its resiliently elastic portion stretched and can extend transversely through the cavity; and a decorative structure supported on the elongate member in the cavity of the balloon.

16 Claims, 3 Drawing Sheets

BALLOON WITH ELASTIC ELONGATE MEMBER SUPPORTING A DECORATIVE STRUCTURE

TECHNICAL FIELD

The present invention relates to toy balloons and means for providing decoration and/or illumination within such a balloon for amusement purposes when the balloon is inflated.

DISCLOSURE OF INVENTION

The present invention provides means for positioning and maintaining the position of a decorative structure and/or a light source in a toy balloon at predetermined position with respect to the balloon such as generally centrally in or along a diametrical line through its cavity to provide striking and pleasing visual effects for balloons used, for example, at parties or carnivals.

According to the present invention there is provided the combination of (1) a toy balloon of the type comprising a thin flexible wall (which wall may be transparent or translucent and may or may not be resiliently stretchable) having an inner surface defining a cavity and including an inlet portion defining a through inlet opening into the cavity through which gas under pressure can be directed into the cavity to inflate the balloon; (2) an elongate member comprising a resiliently elastic portion (e.g., an elastic band, or a combination of an elastic band and a length of non elastic cord or polymeric monofilament) adapted to extend transverse of the cavity from the inlet portion of the balloon when the balloon is inflated; (3) means for attaching one end of the elongate member to the wall of the balloon at a position opposite its inlet portion and for securing a portion of the elongate member at the inlet portion so that upon a predetermined amount of inflation of the balloon the elongate member can be tensioned between the means for attaching and the inlet portion with its resiliently elastic portion extended or stretched and the elongate member extending transversely through the cavity; and (4) a decorative structure adapted to be supported on the elongate member between the means for attaching and the inlet portion of the balloon. The extension or stretching of the elastic portion of the elongate member in the inflated balloon insures that the decorative structure will be positioned in about the same predetermined location in the cavity of the balloon even though the wall of the balloon flexes or changes shape during use, including when with time the balloon looses some of the gas (e.g., helium) with which it was inflated, so that the balloon will retain a pleasing appearance during such wall movement and for a longer period of time than it would if the elongate member in the inflated balloon did not comprise a stretched resiliently elastic portion.

The decorative structure supported in the cavity of the balloon preferably has the shape of the object it represents and can have almost any shape, such as that of a flower, a bird, a fish, an insect such as a butterfly, a planet or moon, an airplane or helicopter, etc. The wall of the balloon can also bear decorative indicia that compliments the structure supported within the balloon, such as tree limbs in combination with a bird, seaweed in combination with an angelfish, flowers in combination with a butterfly, or clouds in combination with an airplane or helicopter. Such combinations provide a striking visual effect. Also, the decorative structure can be supported on the elongate member by means which afford movement of the decorative structure around the elongate member within the cavity of the balloon.

The means for attaching one end of the elastic elongate member to the wall can comprise a post having a portion at a second end adapted to have the elongate member attached thereto, a head at a first end, a portion adjacent the head and between the head and its second end having a diameter smaller than the head, and a band. The head is positionable adjacent the inner surface of the wall at a portion of the wall, and the band is engageable around the portion of the wall and the portion of the post adjacent the head to attach the head to the wall.

The means for securing one end of the elongate member at the inlet portion can be provided by tying or clamping the inlet portion around a portion of the elongate member, or can be provided by a blocking and holding structure having a peripheral surface adapted to be received in the inlet portion of the balloon wall with a first end to which the elongate member can be attached adjacent the cavity and the inner surface of the inlet portion tightly engaging its peripheral surface portion to restrict gas escaping therebetween.

If it is desired to have within the cavity of a balloon both a decorative structure and a light source structure capable of emitting light without generating a significant amount of heat to illuminate the decorative structure, the means for attaching one end of the elongate member to the wall can comprise a translucent or transparent stiff tubular receptacle, a portion at a second end of the receptacle adapted to have the elongate member attached thereto, a central socket opening through the first end of the receptacle and adapted to receive the light source structure, and means for attaching the first end of the tubular receptacle to the wall of the balloon along its inner surface and for sealing the wall to the tubular receptacle around its first end so that an opening can be formed in the wall of the balloon to gain access to the socket to afford positioning the light source structure in the socket generally at the predetermined position within the cavity of the inflated balloon. This means for attaching and sealing the first end of the tubular receptacle to the wall of the balloon can comprise the tubular receptacle having a radially projecting head at its first end. The head can then be positionable adjacent the inner surface of the wall, and the band can be engaged around a portion of the wall and the receptacle adjacent the head to attach the head to the wall.

Alternatively, the tubular receptacle described above can be used without the elongate member, the blocking and holding structure and decorative structure as described above, and/or can further include a translucent or transparent stiff support wall around and spaced from the tubular receptacle, decorative indicia on the support wall, and means for supporting the support wall on the tubular receptacle.

At sea level one cubic foot of helium gas commonly used to inflate balloons can lift about one ounce of weight at room temperature. Thus the balloon, the elongate member, the means for attaching, the blocking and holding structure, and the decorative structure should have a weight of less than about one ounce per cubic foot of area of the cavity of the inflated balloon which is possible using the structures described above.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
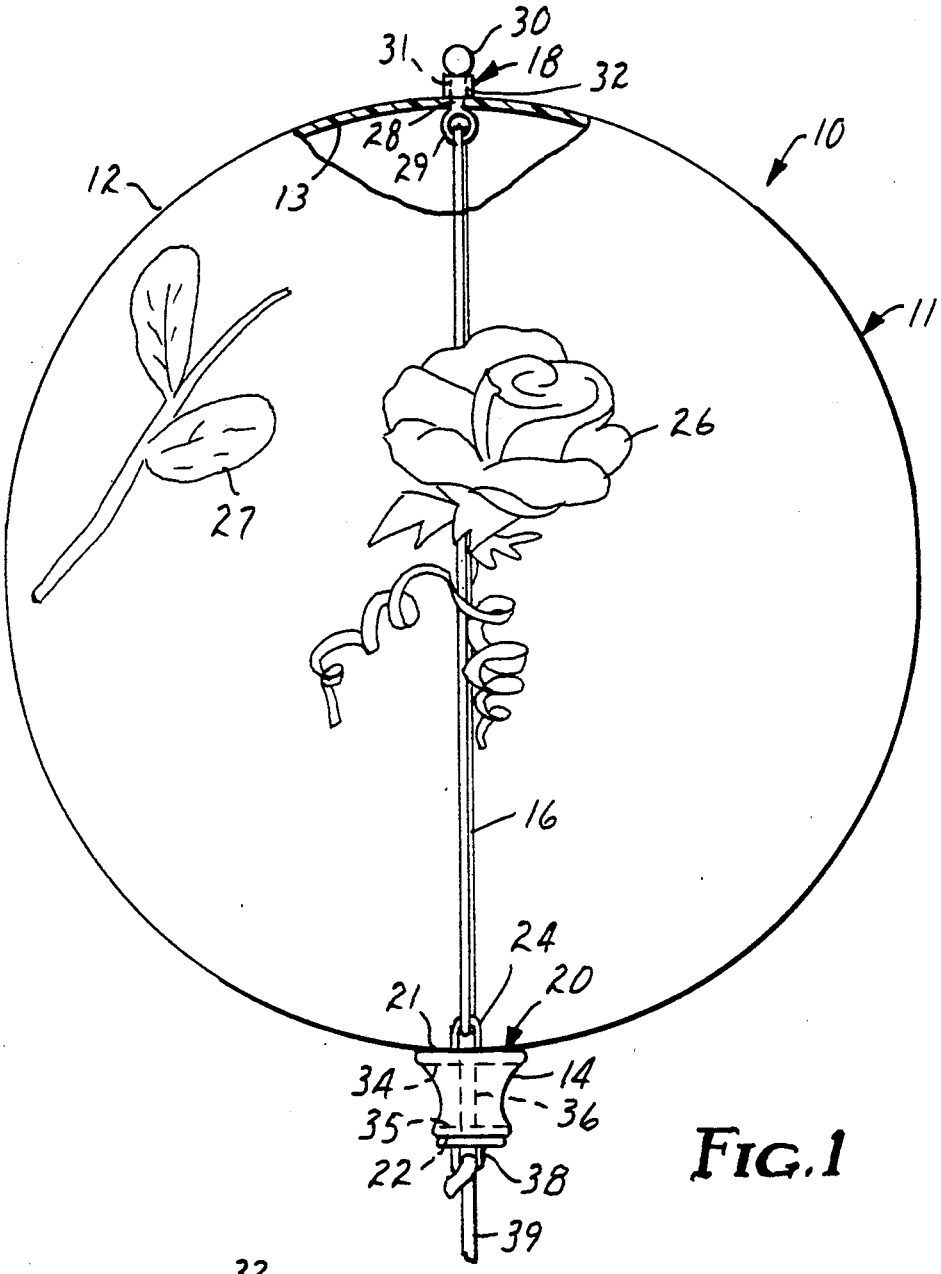
FIG. 1 is a side view of a first embodiment of a combination according to the present invention comprising an inflated toy balloon, an elongate member comprising a resiliently elastic portion extending transverse of the cavity in the balloon, and a decorative structure supported on the elongate member, and in which a portion of the balloon wall is broken away to show details.
Figure 2:
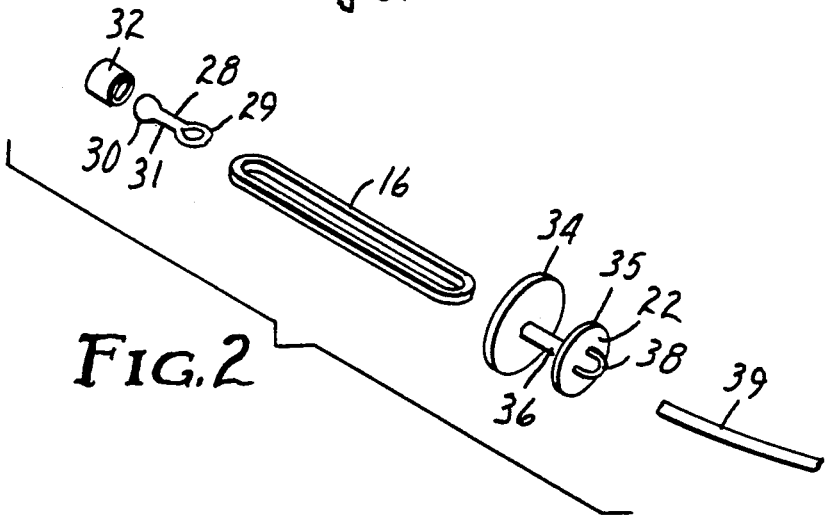
FIG. 2 is a perspective view of structures used to support the decorative structure in the balloon in the embodiment of FIG. 1.

Referring now to the drawing, there is shown in FIGS. 1 and in part in FIG. 2 a first embodiment of a combination according to the present invention generally designated by the reference numeral 10.

Generally the combination 10 comprises (1) a toy balloon 11 comprising a thin flexible transparent or translucent wall 12, which wall 12 may be made of a polymeric material or of a resiliently stretchable material, has an inner surface 13 defining a cavity and includes an inlet portion 14 that defines a through inlet opening into the cavity through which gas under pressure can be directed into the cavity to inflate the balloon; (2) an elongate resiliently elastic member or band 16 adapted to extend transverse of the cavity when the balloon 11 is inflated as illustrated; (3) means 18 for attaching one end of the elastic band 16 to the wall 12 of the balloon 11 at a position opposite the inlet portion 14; (4) means for securing a portion of the elongate member 16 at the inlet portion 14 comprising a blocking and holding structure 20 having first and second ends 21 and 22, a peripheral surface adapted to be received in the inlet portion 14 of the balloon wall 12 with the first end 21 of the structure 20 adjacent the cavity and the inner surface of the inlet portion 14 tightly engaging its peripheral surface to restrict gas escaping therebetween, and a loop 24 at the first end of the structure 20 for attaching the elastic band 16 to the first end so that upon a predetermined amount of inflation of the balloon 11 as is illustrated in FIG. 1 the elastic band 16 can be tensioned between the means 18 for attaching to the wall 12 and the blocking and holding structure 20 at a predetermined position extending transversely through the cavity; and (5) a decorative structure 26 illustrated as a flower or rose (but which could alternatively be any other decorative structure) adapted to be attached to the elastic band 16 between the means 18 for attaching to the wall 12 and the blocking and holding structure 20. The balloon wall 12 also bears decorative indicia 27 depicting branches and leaves of a rose plant that compliments the rose shaped structure supported within the balloon to provide an overall striking visual effect from the combination.

The means 18 illustrated in FIG. 1 for attaching one end of the elastic band 16 to the wall 12 comprises a post 28 (see also FIG. 2), a portion in the form of an annular loop 29 at a second end of the post 28 adapted to have the elastic band 16 attached thereto, a spherical head 30 (e.g., ¼ inch diameter) at an opposite first end of the post 28, a portion 31 adjacent the head 30 and between the head 30 and the loop 29 at the second end of the post 28 having a diameter smaller than the head 30, and a band 32 preferably comprising a short length of hollow polymeric tubing (e.g., a ¼ inch long length of polyvinyl chloride tubing having a 0.08 inch inside diameter and an 0.125 inch outside diameter), but which could alternatively be a length of cord or other material that could be tied around the portion 31 of the post 28. The head 30 is positioned adjacent the inner surface 13 of the wall 12 at a portion of the wall 12; and the band 32 is engaged around that portion of the wall 12 and the portion 31 of the post 28 adjacent the head 30 to attach the end of the post 28 including the head 30 to the wall 12.

The blocking and holding structure 20 is generally spool like in shape, includes a first disk like portion 34 at its first end 21 of a first diameter (e.g., 1.6 centimeters or 0.63 inch) and a second disk like portion 35 at its second end of a second slightly smaller diameter (e.g., 1.27 centimeters or 0.5 inch), which disk like portions 34 and 35 are attached together in parallel spaced relationship by a central coaxial support rod 36. The disk like portions 34 and 35 define the peripheral surface of the structure 20 adapted to be received in the inlet portion 14 of the balloon wall 12 with the inner surface of the inlet portion 14 tightly engaging the peripheral surface portion to restrict gas escaping therebetween. The loop 24 on the blocking and holding structure 20 for attaching the elastic band 16 projects from the side of the first disk like portion 34 opposite the second disk like portion 35, and the structure 20 also has a loop 38 formed on the side of the second disk like portion 35 opposite the first disk like portion 34 to provide means at its second end 22 adapted to have a string 39 attached thereto by which the balloon 11 or combination 10 may be held or tethered to keep it from floating away.

Figure 3:
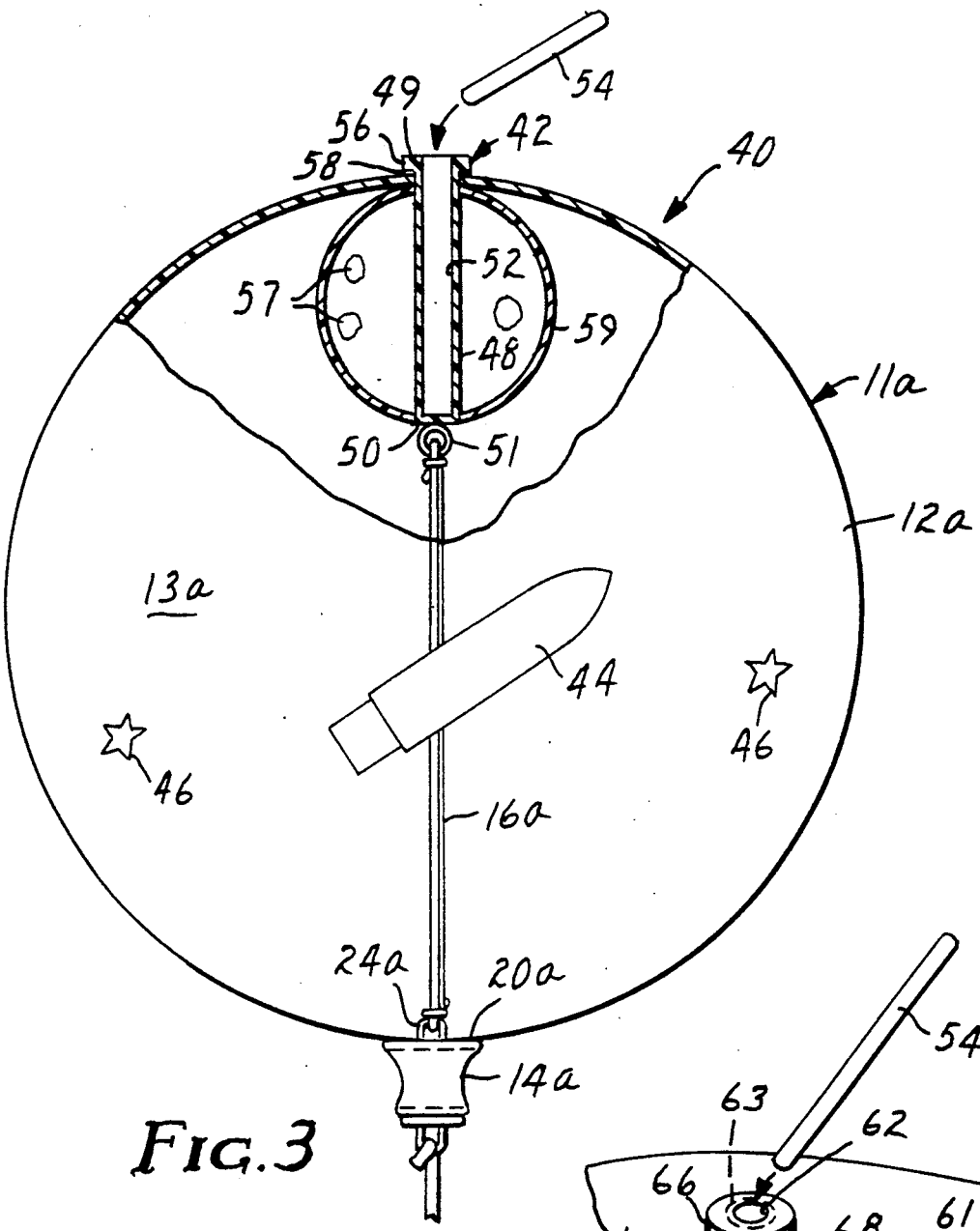
FIG. 3 is a side view of a second embodiment of a combination according to the present invention in which structures used to support a decorative structure in an inflated toy balloon include means for supporting a light source shown in cross section and in which a portion of the balloon wall is broken away to show details.

Referring now to FIG. 3 of the drawing, there is shown a second embodiment of a combination according to the present invention generally designated by the reference numeral 40. The combination 40 includes many of the same structures as the combination 10 (which same structures are identified with the same reference numerals to which have been added the suffix "a", and differs from the combination 10 only by the structure of means 42 for attaching one end of an elastic elongate member or band **16*a* to a wall 12*a* of a balloon 11*a* at a position opposite an inlet portion 14*a* of the balloon 11*a***.

Generally, like the combination 10, the combination 40 comprises (1) the toy balloon **11*a*; (2) the elongate resiliently elastic elongate member or band 16***a* adapted to extend transverse of the cavity when the balloon 11*a* is inflated as illustrated; (3) the means 42 for attaching one end of the elastic band 16*a* to the wall 12*a* of the balloon 11*a* at a position opposite the inlet portion 14*a;* (4) means for securing a portion of the elongate 16*a* at the inlet portion 14*a* comprising a blocking and holding structure 20*a* having first and second ends, a peripheral surface adapted to be received in the inlet portion 14*a* of the balloon wall 12*a* with the first end 21*a* of the structure 20*a* adjacent the cavity and the inner surface of the inlet portion 14*a* tightly engaging its peripheral surface to restrict gas escaping therebetween, and a loop 24*a* at the first end of the structure 20*a* for attaching the elastic band 16*a* so that upon a predetermined amount of inflation of the balloon 11*a* the elastic band 16*a* can be stretched and tensioned between the means 42 for attaching to the wall 12*a* and the blocking and holding structure 20*a* at a predetermined position extending transversely through the cavity; and (5) a decorative structure 44, illustrated as a rocket, adapted to be attached to the elastic band 16*a* between the means 42 for attaching to the wall 12*a* and the blocking and holding structure 20*a*. The balloon wall 12*a* also bears decorative indicia 46 depicting stars that compliment the rocket shaped decorative structure 44 supported within the balloon 11*a* to provide an overall striking visual effect from the combination.

In the combination 40 illustrated in FIG. 3, the means 42 for attaching one end of the elastic elongate member 16*a* to the wall 12*a* comprises a translucent or transparent stiff tubular receptacle 48 having first and second ends 49 and 50, a portion or loop 51 at its second end 50 adapted to have the elastic elongate member 16*a* attached thereto, a central socket 52 opening through its first end 49 and adapted to receive an elongate light source structure 54, and means for attaching a portion of the receptacle 48 adjacent its first end 49 to the wall 12*a* of the balloon 11*a* along its inner surface 13*a*, and for sealing the wall 12*a* to the tubular receptacle 44 around its first end 49 sufficiently that an opening can be formed or cut in the wall 12*a* of the balloon 11*a* to gain access to the socket 52 and afford positioning the light source structure 54 in the socket 52 and generally at the predetermined position within the cavity of the inflated balloon 11*a*.

The means for attaching the portion of the receptacle 48 adjacent its first end 49 to the wall 12*a* of the balloon 11*a* along its inner surface and for sealing the wall 12*a* to the tubular receptacle 44 around its first end 49 comprises the tubular receptacle 48 having a radially projecting annular head 56 at its first end 49 and the combination including a band 58 (which may be a resiliently elastic band or a length of cord or string); the head 56 being positionable against the inner surface 13*a* of the wall 12*a* at a portion of the wall 12*a;* and the band 58 being engageable around the portion of the wall 12*a* and the the receptacle 48 adjacent the head 56 to attach the head 56 to the wall 12*a*.

As illustrated, the receptacle 48 can further include a translucent or transparent generally spherical stiff support wall 59 around and spaced from the tubular receptacle 48, decorative indicia 57 on the support wall 59 to give it a decorative appearance, such as in the shape of craters as illustrated to give it the appearance of the Moon, and means for supporting the support wall 59 on the tubular receptacle 48 provided by adhesively attaching edges of the support wall 59 to the receptacle 48 as illustrated.

The elongate light source structure 54 may comprise a light stick of the type described above that is commercially available from American Cyanamid Company, Wane, N.J. under the trade designation "Cyalume Lightstick", is described in U.S. Pat. Nos. 3,576,987 and 3,597,362, (the content whereof are incorporated herein by reference), and generally comprises a stiff polymeric housing defining a plurality of cavities, a plurality of chemical substances within the cavities which upon being mixed together will react to emit visible light, and means for affording mixing of the chemical substances within the cavities initiated by manual manipulation of the housing, such as bending of the light stick housing until a glass wall defining one of the cavities ruptures. Alternatively, the light source structure may comprise a polymeric housing in which the chemical substances of the light sticks described in those U.S. Pat. Nos. 3,576,987 and 3,597,362 have been mixed together so that they are reacting to emit light (whereupon their reaction to produce light typically is slowed by cooling until the light source structure is used with the balloon) which housing may be a length of stiff polymeric tubing, or a length of very flexible transparent or translucent polymeric tubing having a central passageway (e.g., tubing of 0.05 inch outside diameter and 0.03 inch inside diameter or smaller) in which the chemical substances are sealed; or may comprise a phosphorescent material of a known type in a stiff or flexible polymeric binder or housing that will cause luminescence upon absorption of visible light and will continue such luminescence for a noticeable time after exposure to visible light has ceased. Whatever type of light source structure 54 is used, it will provide internal lighting in the balloon 11*a* which, particularly in low light, will enhance the visual effect of the decorative structure 44 and the decorative indicia 46 and 57 on the wall 12*a* of the balloon 11*a* and on the support wall 59 respectively.

For use, a balloon vendor is supplied with the combination 40 described above with the balloon 11*a* in an non inflated condition, the receptacle 48 having its head 56 attached to the wall 12*a* of the balloon 11*a* opposite its inlet portion 14*a* by the band 58, and the elastic elongate member 16*a* extending through its inlet portion 14*a*. When the combination 40 is to be prepared for potential sale, the vendor inflates the balloon 11*a* as with helium through its inlet portion 14*a* which is then closed by inserting the blocking and holding structure 20*a*, or if that structure 20*a* is not used, by tying the inlet portion 14*a* around a portion of the elongate member 16*a* or applying a cord or clip of a type that is known for that purpose around the inlet portion 14*a* and a portion of the elongate member 16*a* extending through its inlet portion 14*a;* after which, when the balloon 11*a* is sold, the vendor may, if necessary, bend the light stick 54 to cause it to emit light, and insert it in the socket 52 in the receptacle 48 through the hole in the wall 12*a* of the balloon.

Figure 4:
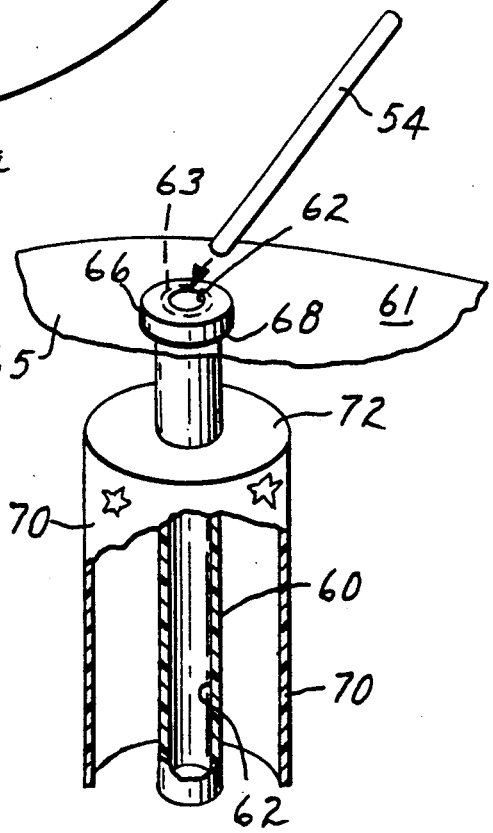
FIG. 4 is a fragmentary perspective side view of a third embodiment of a combination according to the present invention in which the means for supporting a light source in FIG. 3 is used without the decorative structure of FIG. 3.

FIG. 4 illustrates the use of a translucent or transparent stiff tubular receptacle 60 similar to the receptacle 48 in a balloon 61 without an elastic elongate member or band extending transverse of the balloons cavity and without another decorative structure. The receptacle 60 illustrated in FIG. 4 has a central socket 62 opening through a first end 63 and adapted to receive an elongate light source structure 54, and means for attaching a portion of the receptacle 60 adjacent its first end 63 to a wall 65 of the balloon 61 along its inner surface, and for sealing the wall 65 to the tubular receptacle 60 around its first end 63 sufficiently that an opening can be formed or cut in the wall 65 of the balloon 61 to gain access to the socket 62 and afford positioning the light source structure 54 in the socket 62 generally at a predetermined position within the cavity of the inflated balloon 61. As with the receptacle 48, the means for attaching the portion of the receptacle 60 adjacent its first end 63 to the wall 65 of the balloon 61 along its inner surface and for sealing the wall 65 to the tubular receptacle 60 around its first end 63 comprises the tubular receptacle 60 having a radially projecting annular head 66 at its first end 63 and the combination including a band 68 (which may be a resiliently elastic band or a length of cord or string); the head 66 being positionable adjacent the inner surface of the wall 65 at a portion of the wall 65; and the band 68 being engageable around the portion of the wall 65 and the receptacle 60 adjacent its head 66 to attach the head 66 to the wall 65. As illustrated in FIG. 4, a translucent or transparent stiff cylindrical support wall 70 bearing decorative indicia is positioned coaxially around and spaced from the tubular receptacle 60 from which it is supported by a disk like end wall 72 having an inner edge fixed on the tubular receptacle 60, extending radially of the tubular receptacle 60, and having an outer edge fixed on the support wall 70

Figure 5:
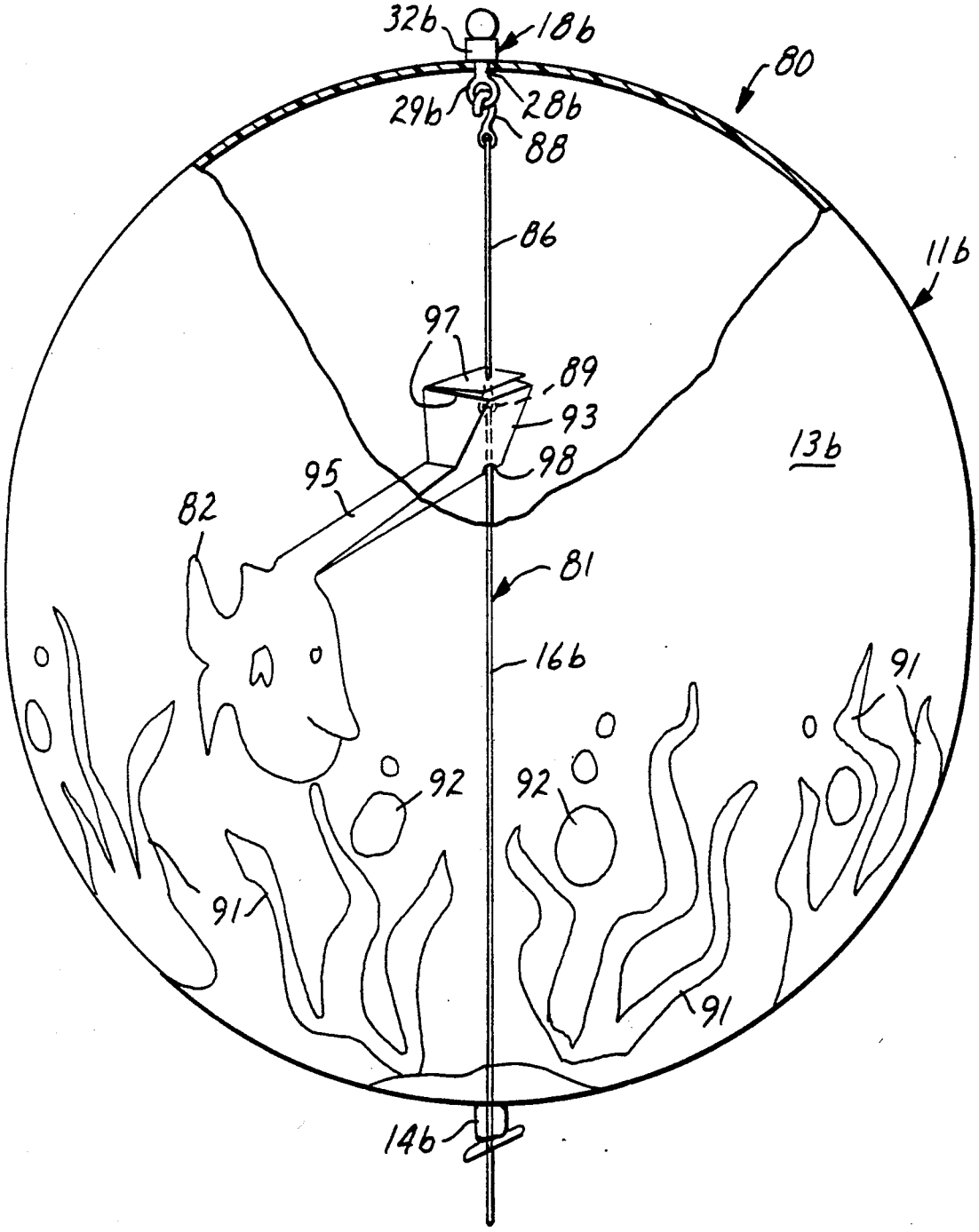
FIG. 5 is a side view of a forth embodiment of a combination according to the present invention comprising an inflated toy balloon, a elongate member including resiliently elastic and non elastic portions and extending transverse of the cavity in the balloon, and a decorative structure movably supported on the elongate member, and in which a portion of the balloon wall is broken away to show details.

Referring now to FIG. 5 of the drawing, there is shown a forth embodiment of a combination according to the present invention generally designated by the reference numeral 80. The combination 80 includes many of the same structures as the combination 10 (which same structures are identified with the same reference numerals to which have been added the suffix "b", and differs from the combination 10 primarily in the way a decorative structure 82 in the shape of a fish is supported on an elongate member 81 including a resiliently elastic portion or band **16*b* so that the fish shaped structure 82 can move in circles around the elongate member 81 within a cavity in the balloon 11*b***.

Generally, like the combination 10, the combination 80 comprises (1) the toy balloon **11*b*; (2) the elongate member 81 including the resiliently elastic band 16*b* and a length of non elastic cord 86 attached at one end by a ring 89 to the band 16*b*, which elongate member 81 is adapted to extend transverse of the cavity of the balloon 11*b* and through the inlet portion 14*b* of the balloon 11*b* with the band 16*b* stretched or extended when the balloon 11*b* is inflated and the inlet portion 14*b* is closed and attached to the band 16*b* by means such as by being tied as illustrated; (3) means 18*b* including a post 28*b* and a band 32*b*, and a loop 29*b* on the post 28*b* to which the end of the length of non elastic cord 86 opposite the ring 89 is attached by a hook 88 for attaching one end of the elongate member 81 to the wall 12*b* of the balloon 11*b* at a position opposite its inlet portion 14*b*; and (4) the decorative structure 82, illustrated as a fish, adapted to be supported by the elongate member 81 within the cavity 13*b* of the balloon 11*b* between the means 18*b* for attaching to the wall 12*b* and the inlet portion 14*b* of the balloon 11*b*. The balloon wall 12*b* also bears decorative indicia 91 and 92 depicting seaweed and bubbles that compliment the fish shaped decorative structure 82 supported within the balloon 11*b*** to provide an overall striking visual effect from the combination.

The fish shaped decorative structure 82 illustrated is generally planar and formed from a single stiff sheet (e.g., a printed and die cut sheet of 0.01 inch thick acetate). A support arm 95 folded from the same sheet from which the structure 82 is made projects at generally a right angle from a top edge of the structure 82. A distal bearing end 93 of the support arm 95 is formed by folded up portions of the sheet defining the arm 95 to form a structure that is generally triangular in cross section in that it has an upper normally horizontal portion defined by overlapping portions 97 of the sheet that have aligned generally central openings through which the cord 86 extends with the lowermost of the overlapping portions 97 bearing against the top of the ring 89, and a lower portion defined by a v-shaped bend along the portion of the sheet defining the arm which has an opening 98 through which the band **16*b* extends. The bearing end 93 of the arm 95 will rotate about the elongate member 81 so that the fish shaped structure 82 at the opposite end of the support arm 95 will revolve around the elongate member 81 when the balloon 11*a* is tipped from side to side as by air currents. The extension or stretching of the elastic band 16*b* in the inflated balloon 11*b* insures that the decorative fish shaped structure 82 will be supported by the support arm 95 along its circular path at about the same spacing from and angle with respect to the elongate member 81 in the cavity of the balloon 11*b* even though the wall 12*b* of the balloon 11*b* flexes or changes shape during use, or the balloon 11*b* with time looses some of the gas or helium with which it was inflated, so that the balloon 11*b* will retain a pleasing appearance and the structure 82 will be able to properly move or revolve around the elongate member 81**.

The present invention has now been described with reference to several embodiments and modifications thereof. It will be apparent to those skilled in the art that many changes can be made in the embodiments described without departing from the scope of the present invention. For example, the decorative structure supported on the elastic elongate member in the balloon can be a trinket or small toy to be played with after the balloon has completed its life cycle, or can be a decorated or transparent package containing such a trinket or small toy. Thus the scope of the present invention should not be limited to the structures described in this application, but only by structures described by the language of the claims and the equivalents of those structures.

I claim:

1. In combination, a toy balloon comprising a thin flexible transparent or translucent wall having an inner surface defining a cavity and including an inlet portion defining a through inlet opening into said cavity through which gas under pressure can be directed in said cavity to inflate said balloon;

an elongate member comprising a resiliently elastic portion and having a length adapted to extend transverse of said cavity from said inlet portion when said balloon is inflated;

means for attaching one end of said elongate member to said wall at a position generally opposite said inlet opening and for securing a portion of said elongate member at said inlet portion so that upon a predetermined amount of inflation of said balloon said elongate member can be tensioned between said means for attaching and said inlet portion with said resiliently elastic portion extended and extending transversely through said cavity; and a decorative structure adapted to be supported by said elongate member in said cavity between said means for attaching and said inlet portion.

2. A combination according to claim 1 wherein said means for attaching one end of said elongate member to said wall comprises a post having first and second ends, a portion at said second end adapted to have said elongate member attached thereto, a head at said first end, a portion adjacent said head and between said head and said second end having a diameter smaller than said head, and a band; said head being positionable adjacent the inner surface of said wall at a portion of said wall; and said band being engageable around said portion of said wall and said portion of said post adjacent said head to attach said head to said wall.

3. A combination according to claim 1 wherein said means for securing a portion of said elongate member at said inlet portion comprises a blocking and holding structure having first and second ends, a peripheral surface adapted to be received in said inlet portion of said balloon wall with said first end adjacent said cavity and the inner surface of said inlet portion tightly engaging said peripheral surface portion to restrict gas escaping therebetween, and means for attaching said elongate member to said first end.

4. A combination according to claim 3 wherein said blocking and holding structure is a generally spool like structure having a first disk like portion of a first diameter at said first end, and a second disk like portion of a second smaller diameter at said second end, said disk like portions defining said peripheral surface adapted to be received in said inlet portion of said balloon wall with the inner surface of said inlet portion tightly engaging said peripheral surface portion to restrict gas escaping therebetween, said blocking and holding structure has a loop formed on the side of said first disk like portion opposite said second disk like portion to provide said means for attaching said elongate member to said first end, and has a loop formed on the side of said second disk like portion opposite said first disk like portion to provide means at said second end adapted to have a string attached thereto.

5. A combination according to claim 1 wherein said elongate member comprises a resiliently elastic rubber band.

6. A combination according to claim 1 wherein said decorative structure has the actual shape of an object selected from the group consisting of a flower, a fish, a bird, an insect, or an inanimate object, and said wall bears decorative indicia that compliments said decorative structure.

7. A combination according to claim 1 further including means for supporting said decorative structure on said elongate member for movement of said decorative structure around said elongate member within said cavity.

8. A combination according to claim 7 wherein said means for supporting said decorative structure on said elongate member for movement of said decorative structure around said elongate member within said cavity comprises a bearing member along said elongate member, and a support arm having an outer end fixed to said decorative structure and a distal bearing end mounted on said elongate member and supported on said bearing member for rotation around said elongate member with said support arm projecting at about a right angle from said elongate member.

9. A combination according to claim 8 wherein a portion of said elongate member between said bearing member and said means for attaching one end of said elongate member to said wall is non elastic, and a portion of said elongate member between said bearing member and said inlet portion is resiliently elastic.

10. A combination according to claim 1 wherein said means for attaching one end of said elongate member to said wall comprises a post having first and second ends, a portion at said second end adapted to have said elongate member attached thereto; a spherical head at said first end, a portion adjacent said head and between said head and said second end having a diameter smaller than said head, and a band comprising a short length of hollow polymeric tubing; said head being positionable adjacent the inner surface of said wall at a portion of said wall; and said band being engageable around said portion of said wall and said portion of said post adjacent said head to attach said head to said wall.

11. In combination, an inflated toy balloon comprising a thin flexible transparent or translucent wall having an inner surface defining a cavity and including an inlet portion defining a through inlet opening into said cavity;

an elongate member comprising a resiliently elastic portion and having a length adapted to extend transverse of said cavity from said inlet portion when said balloon is inflated;

means attaching one end of said elongate member to said wall at a position generally opposite said inlet opening and securing a portion of said elongate member at said inlet portion with said resiliently elastic portion extended and said elongate member extending transversely through said cavity; and a decorative structure supported by said elongate member in said cavity between said inlet portion and said means attaching said elongate member to said wall.

12. A combination according to claim 11 wherein said means attaching one end of said elongate member to said wall comprises a post having first and second ends, a portion at said second end having said elongate member attached thereto, a head at said first end, a portion adjacent said head and between said head and said second end having a diameter smaller than said head, and a band; said head being positioned adjacent the inner surface of said wall at a portion of said wall; and said band being engaged around said portion of said wall and said portion of said post adjacent said head to attach said head to said wall.

13. A combination according to claim 1 further including a light source structure capable of emitting light without generating a significant amount of heat; and wherein said means for attaching one end of said elongate member to said well comprises.

a translucent or transparent stiff tubular receptacle having first and second ends, a portion at said second end adapted to have said elongate member attached thereto, a central socket opening through said first end and adapted to receive said light source structure; and means for attaching said first end of said tubular receptacle to the wall of said balloon along said inner surface, and for sealing said wall to said tubular receptacle around first end sufficiently that an opening can be formed in said wall to gain access to said socket to afford positioning said light source structure in said socket generally at said predetermined position within the cavity of the inflated balloon.

14. A combination according to claim 13 wherein said means for attaching said first end of said tubular receptacle to the wall of said balloon along said inner surface and for sealing said wall to said tubular receptacle around first end sufficiently that an opening can be formed in said wall to gain access to said socket to afford positioning said light source structure in said socket generally at said predetermined position within the cavity of the inflated balloon comprises said tubular receptacle having a radially projecting head at said first end and said combination including a band; said head being positionable adjacent the inner surface of said wall as a portion of said wall; and said band being engageable around said portion of said wall and said receptacle adjacent said head to attach said head to said wall.

15. A combination according to claim 14 further including a translucent or transparent stiff support wall around and spaced from said tubular receptacle, decorative indicia on said support wall, and means for supporting said support wall on said tubular receptacle.

16. A combination according to claim 11 further including a light source structure capable of emitting light without generating a significant amount of heat; and wherein said means attaching one end of said elongate member to said wall comprises.

a translucent or transparent stiff tubular receptacle having first and second ends, a portion of said second end having said elongate member attached thereto, a central socket opening through said first end and adapted to receive said light source structure; and means attaching said first end of said tubular receptacle to wall of said balloon along said inner surface, and sealing said wall to said tubular receptacle around first end sufficiently that an opening is formed in said wall to gain access to said socket to afford positioning said light source structure in said socket generally at said predetermined position within the cavity of the inflated balloon.

* * * * *